US005529351A

United States Patent [19]

Donald

[11] Patent Number: 5,529,351

[45] Date of Patent: Jun. 25, 1996

[54] SLIDING DOOR SELF-LATCHING APPARATUS

[76] Inventor: Joseph G. Donald, 2539 Mercantile Dr. Suite 1, Rancho Cordova, Calif. 95742

[21] Appl. No.: 396,557

[22] Filed: Mar. 1, 1995

Related U.S. Application Data

[63] Continuation-in-part of Ser. No. 210,694, Mar. 17, 1994, Pat. No. 5,452,928.

[51] Int. Cl.[6] ..... E05B 15/00

[52] U.S. Cl. ..... 292/254; 292/191; 292/169.13

[58] Field of Search ..... 292/191, 254, 292/153, 341.17, 169.14, 169.13, 169.16

[56] References Cited

U.S. PATENT DOCUMENTS

| | | | |
|---|---|---|---|
| 195,270 | 9/1877 | Hall . | |
| 205,041 | 6/1978 | Brocksieper . | |
| 2,230,096 | 1/1941 | Voight . | |
| 2,793,894 | 5/1957 | Modes . | |
| 3,600,021 | 8/1971 | Hawkins . | |
| 4,566,725 | 1/1986 | Klein . | |
| 5,452,928 | 9/1995 | Donald | 292/254 |

*Primary Examiner*—Jerry Redman
*Attorney, Agent, or Firm*—James M. Ritchey

[57] ABSTRACT

A latch assembly and self-latching deadbolt assembly for mounting to a sliding door and latching with a strike plate mounted in a door frame. Provided are a housing for fitting within the sliding door, a self-latching deadbolt for engaging with the strike plate, and a mechanism for sliding the self-latching deadbolt between a nonengaging position and an engaging position for latching with the strike plate.

7 Claims, 5 Drawing Sheets

SLIDING DOOR SELF-LATCHING APPARATUS

This application is a continuation in part of Ser. No. 08/210,694 filed Mar. 17, 1994, now U.S. Pat. No. 5,452, 928.

BACKGROUND OF THE INVENTION

1. Field of the Invention

Disclosed is a self-latching mechanism for a sliding door. More specifically, an improved latch device or self-latching deadbolt assembly for a sliding door is provided that includes a deadbolt having with a single lever adapted with resilient means for engaging a strike plate. With the aid of guiding means, the latching mechanism of the self-latching deadbolt assembly functions to engage the strike plate both when the deadbolt is extended before or after closing the door.

2. Description of the Background Art

Door latches for pocket or sliding doors exist in various forms. Many of these latching means have some form of sliding deadbolt that extends, when the door is in a closed position, from within the door and into a receiving strike plate in the door frame. However, the current latching means lack the ability to self-latch if the deadbolt mechanism is extended first and then the door slid into the closed position.

Specifically, U.S. Pat. No. 4,566,725 relates a deadlock mechanism for a sliding door that comprises a pair of levers, each with an ear and a projecting lug. No ability for self-latching is present in this device. As the deadbolt is thrown into the strike plate, the pair of levers extend and lock behind the edges of the strike plate. Should the deadbolt be extended before the door is closed, the projecting levers prevent the deadbolt from entering the strike plate.

The subject invention overcomes the limitations found in the prior art, in which the deadbolt is prevented from entering the strike plate if it is extended before the door is closed, by supplying a self-guiding latching mechanism that reliably hooks and secures the striking plate with the deadbolt either extended or retracted.

SUMMARY OF THE INVENTION

An object of the present invention is to disclose an improved self-latching mechanism for a sliding door.

Another object of the present invention is to provide an improved sliding door latch that repeatedly, reliably, and securely holds a sliding door closed against a strike plate mounted in a door frame.

A further object of the present invention is to disclose an improved simple self-latching pocket door mechanism that utilizes only a guided single latching lever that engages with a receiving strike plate mounted in a door frame.

Still another object of the present invention is to describe an improved self-latching sliding door mechanism that employs a single spring associated lever and guiding means within a deadbolt for engaging and latching with a receiving strike plate mounted in a door frame.

Disclosed is an improved latch assembly for mounting to a sliding door to engagingly latch with a strike plate means. The assembly comprises a housing for fitting within the sliding door. Additionally, provided is a deadbolt assembly comprising a sliding deadbolt member having first and second ends, a lever having first and second ends, hooking means associated with the lever for engaging the strike plate wherein the hooking means comprises a hook formed in the lever proximate the lever first end, a channel formed within the lever extending from proximate the lever second end towards the lever first end, pivoting means for connecting the lever by the channel to the deadbolt member, and biasing means for providing a variable point of pivoting within the channel whereby the pivoting varies from proximate the lever second end toward the lever first end wherein the biasing means comprises a spring fitted within the channel that cooperates with the pivoting means.

Additionally, guiding means are included that assist in the reproducible movement of the hook into and from engaging the strike plate. Comprising the guiding means is a guide aperture, formed proximate the lever first end between the channel and the first end edge of the lever and a guide pin that fits within the guide aperture and is secured by extending into the surrounding deadbolt.

Included is a deadbolt extension means for sliding the deadbolt assembly between a nonengaging position and an engaging position for latching with the strike plate means.

Other objects, advantages, and novel features of the present invention will become apparent from the detailed description that follows, when considered in conjunction with the associated drawings.

DESCRIPTION OF THE PREFERRED EMBODIMENT

Figure 1:
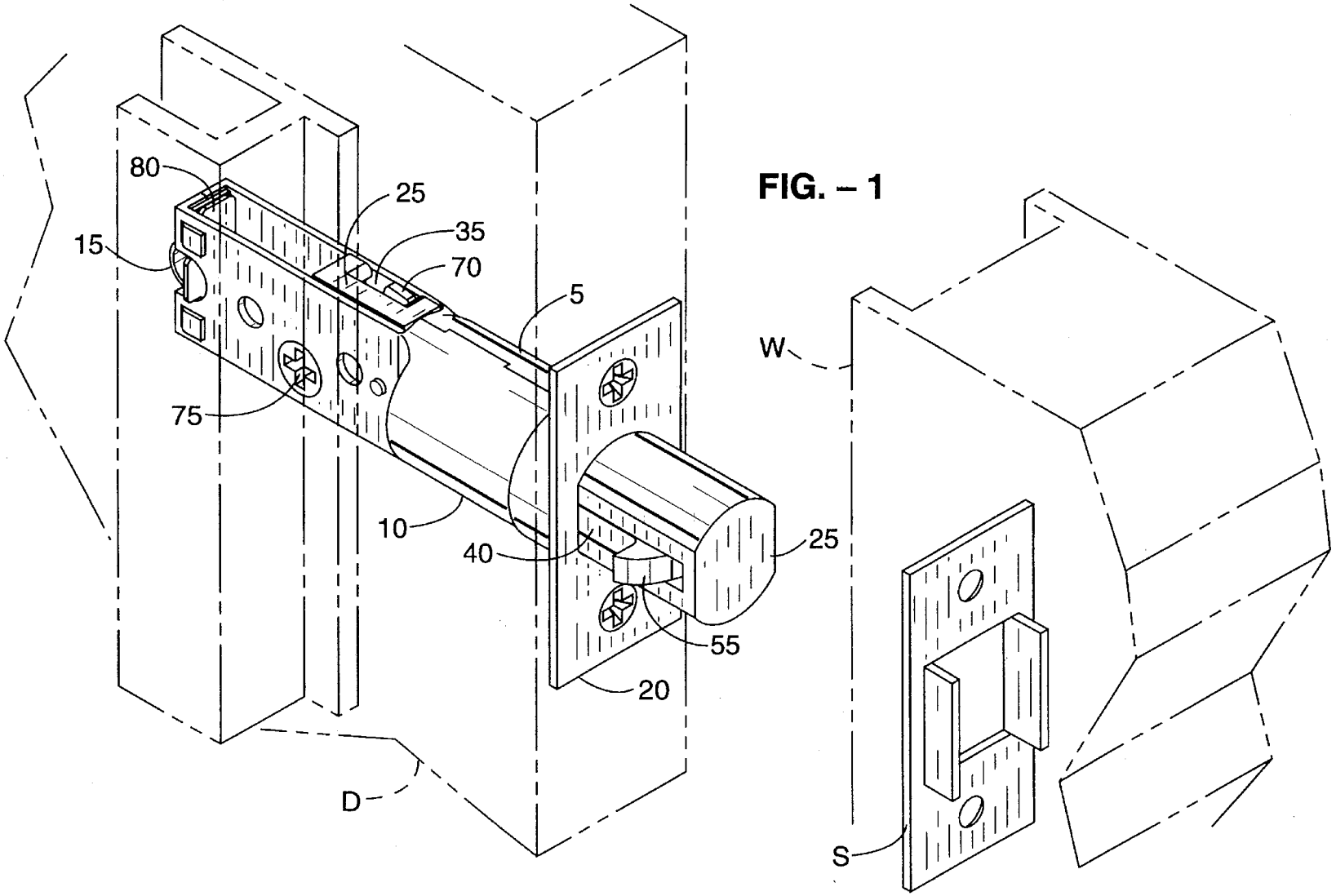
FIG. 1 is a perspective view of the subject invention with the deadbolt in an extended position.

Referring now to FIGS. 1–5, there is shown a preferred embodiment of self-activating and self-guiding spring latch for a sliding door. Normally, the subject device is utilized in connection with a typical sliding door. The sliding door itself is mounted in a pocket frame or equivalent structure that fits within a wall. When a user desires to close the door, the door is slid out of the pocket. The subject invention provides the user with a means for locking the closed door (slid out of pocket) against a strike plate S mounted on the frame.

Specifically, the subject apparatus comprises a housing constructed from a first side plate 5, a second side plate 10, a back plate 15, and a front mounting plate 20. The four housing components (5, 10, 15, and 20) cooperate to hold or encase the remaining elements of the subject apparatus. Other equivalent configurations are contemplated to be within the realm of this disclosure and include fabrication designs that incorporate combined or additional similar elements.

The housing fits within the sliding door D. The front mounting plate is secured to the door D by standard means such as screws, bolts, and the like.

Figure 2:
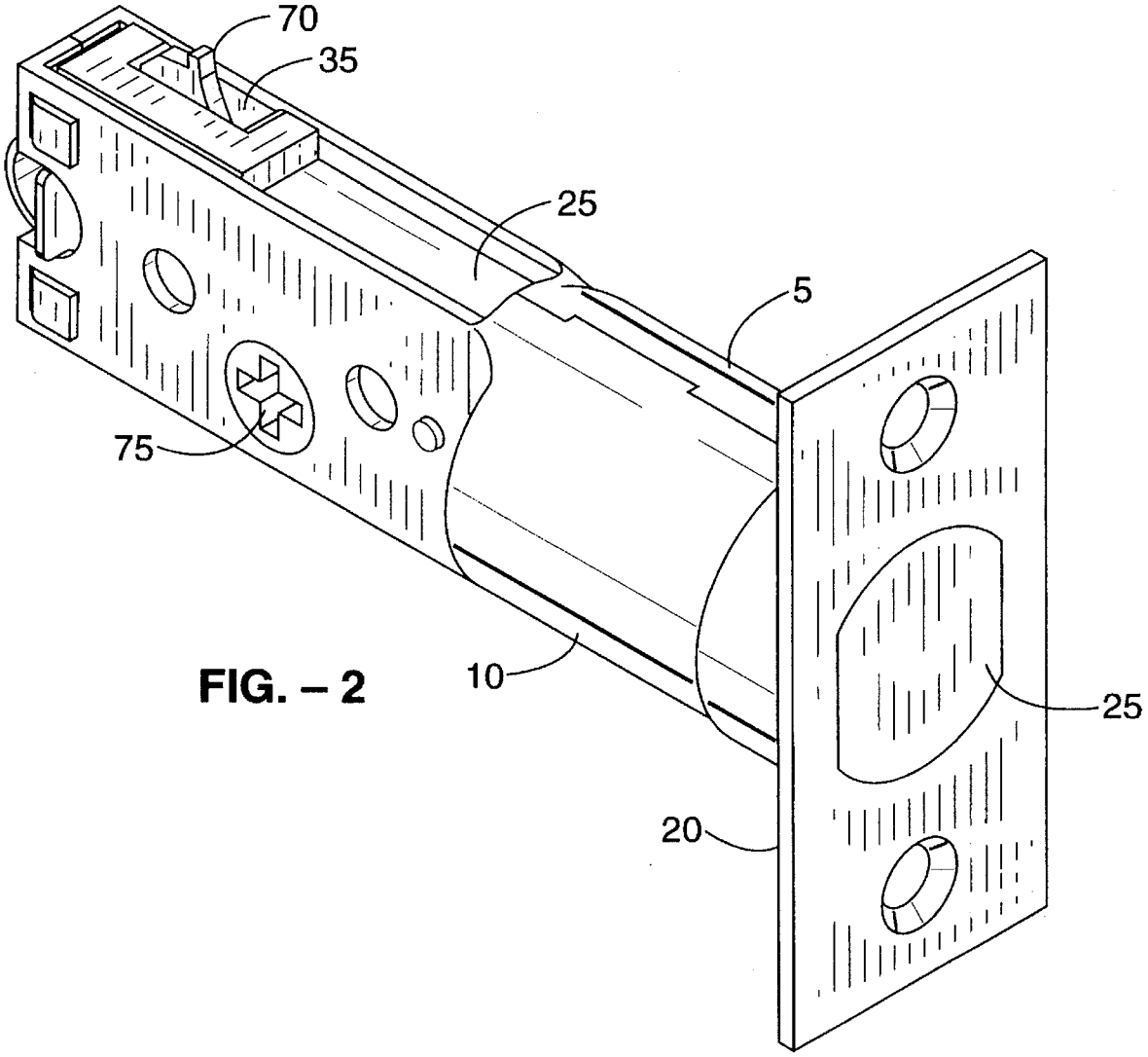
FIG. 2 is a perspective view of the subject invention with the deadbolt in a retracted position.
Figure 3:
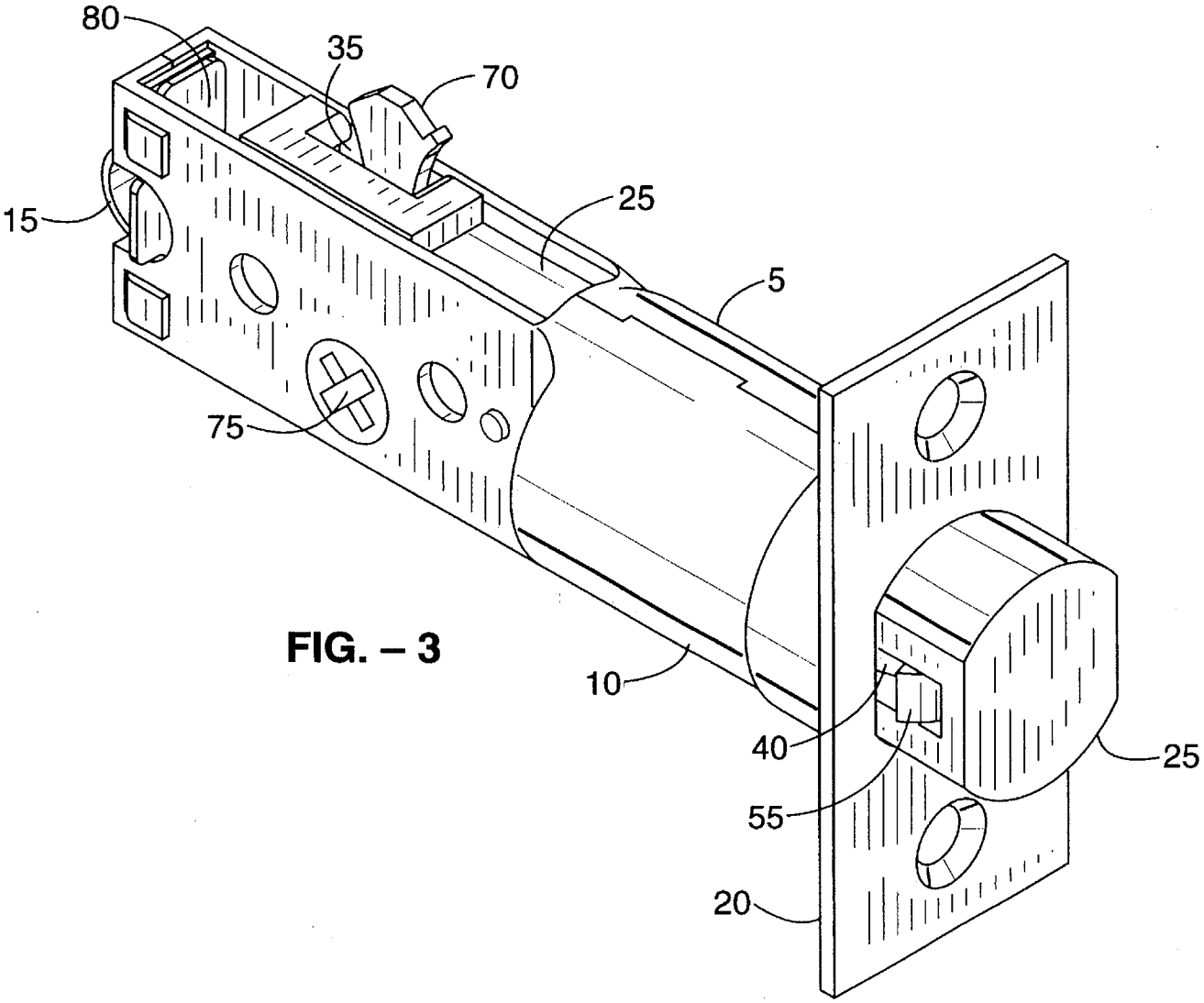
FIG. 3 is a perspective view of the subject invention with the deadbolt in a partially extended position showing the partial pivoting of the lever.
Figure 4:
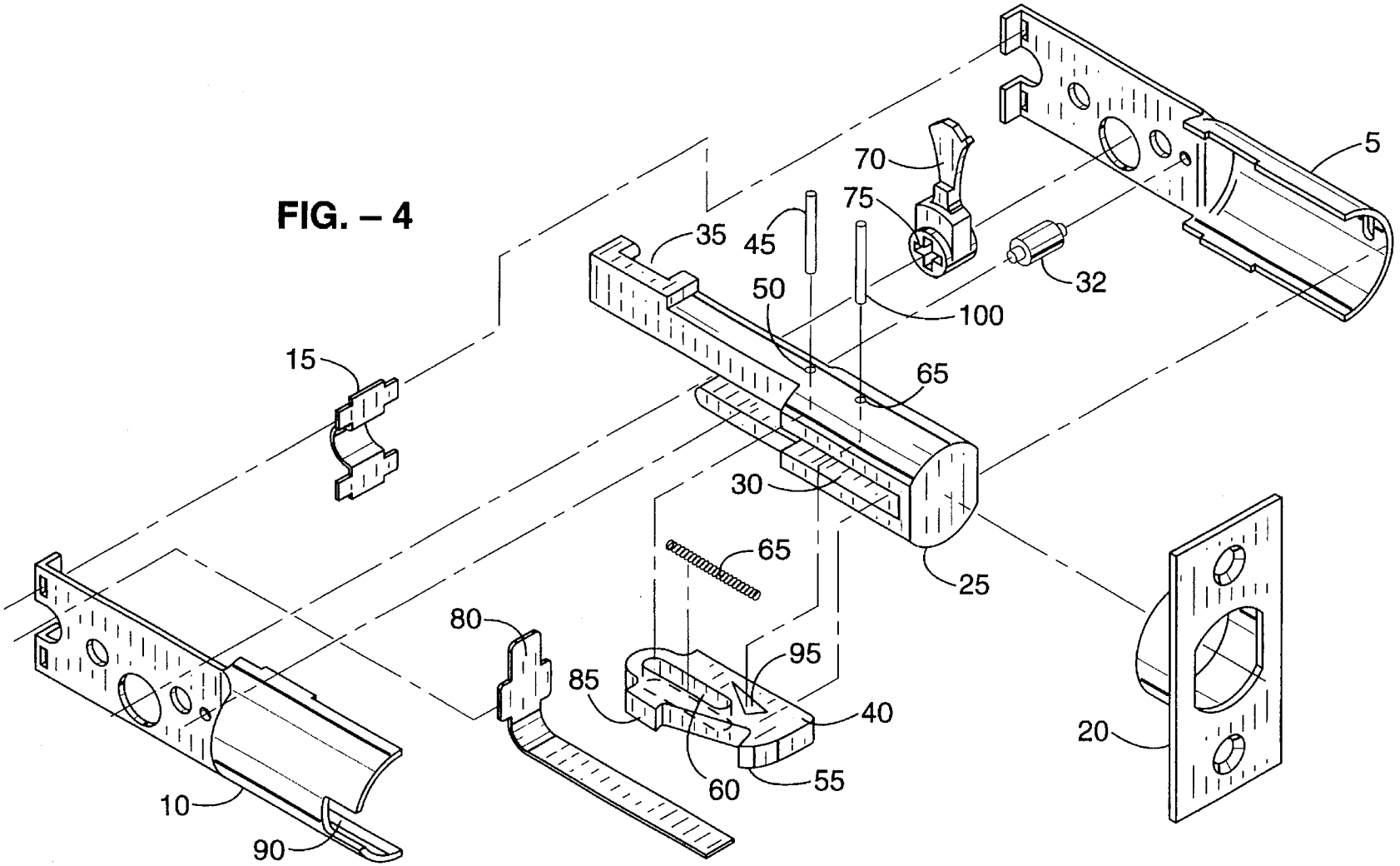
FIG. 4 is an exploded view of the subject invention.
Figure 5:
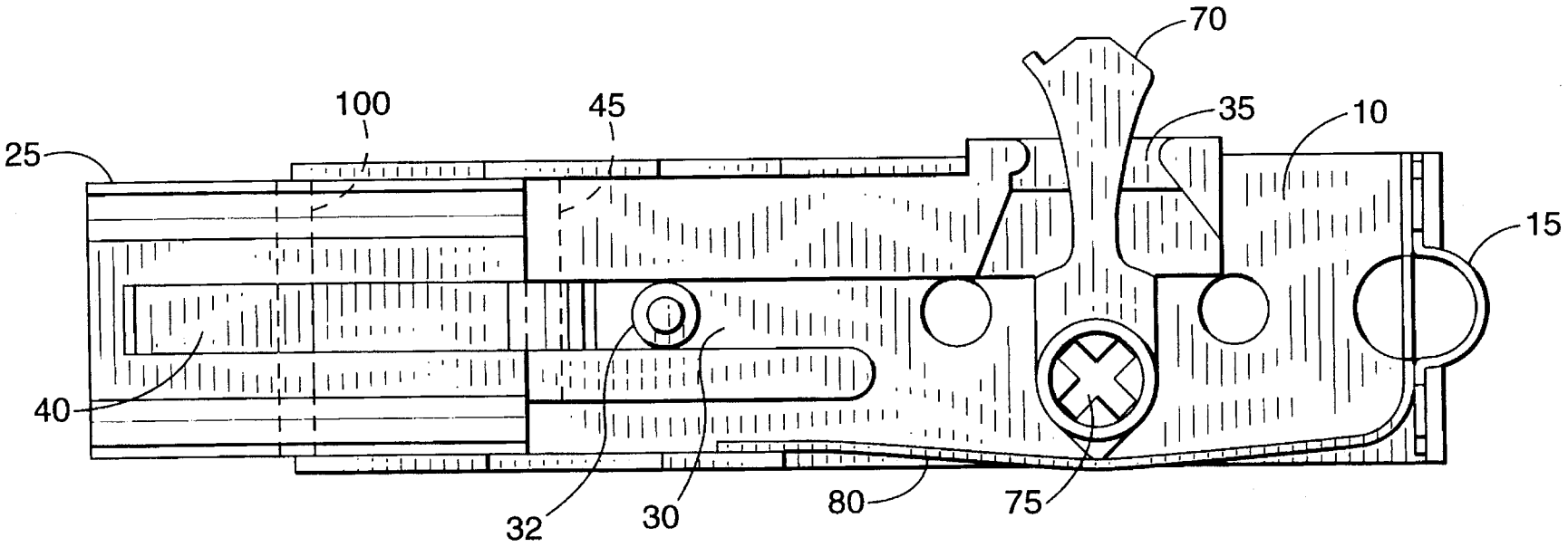
FIG. 5 is a cross-sectional view of the deadbolt assembly, minus the front mounting plate.

Within the housing and part of a deadbolt assembly is a self-latching deadbolt means that engages the strike plate S. As seen in FIGS. 1–5, a deadbolt 25 is held within the housing. FIG. 1 illustrates the deadbolt 25 in an extended and strike plate S engaging position. FIG. 2 depicts the deadbolt 25 in a retracted and strike plate S nonengaging position. FIG. 3 depicts the deadbolt 25 in an intermediate or partially extended position. Although other equivalent conformations are possible for the deadbolt 25, FIGS. 4 and 5 show a typical structure for the deadbolt 25. The deadbolt 25 has a first end that enters the strike plate S and a second end that slides within the housing. A longitudinal aperture 30 is formed in the deadbolt 25 and extends to proximate the deadbolt first end. A notch 35, utilized in sliding the deadbolt 25 between open and closed positions, is formed proximate the deadbolt second end. A deadbolt guide 32 fits within the housing to stabilize the sliding of the deadbolt 25 and securing the two halves of the housing 5 and 10 together.

A lever 40 has a first or head end that extends towards the strike plate S and a second or foot end that is directed away from the strike plate S. When assembled, the lever 40 is fitted within the longitudinal aperture 30 and held by pivoting means that permit pivoting such as a pivot pin 45 mounted in a pivot pin receiving aperture 50 in the deadbolt 25.

Hooking means are associated with the lever first end and are utilized for engaging or hooking within or to the strike plate S when the deadbolt 25 is extended. Preferably, the hooking means comprises a hook 55 formed proximate the lever first end.

A critical element of the present invention is the ability of the device to latch the hook 55 into the strike plate S even if the deadbolt 25 is extended when the sliding door D is closed and the deadbolt 25 inserted into the strike plate S. This hooking or latching ability is provided, in part, by a channel 60 shaped into the lever 40. The channel 60 extends from proximate the lever second end towards the lever first end. Within the channel 60 is a biasing means that is typically a spring 65. The spring 65 fits within the channel 60 and provides a moving pivot point within the channel 60 for the pivot pin 45. If the deadbolt 25 is partially or completely extended when the door is slid shut onto the strike plate S, the hook 55 and associated lever 40 merely compress the spring 65. As the spring 65 compresses and shifts the pivot point, the lever 40 pivots into the longitudinal aperture 30. Since the lever 40 and hook 55 are within the longitudinal aperture 30 the deadbolt 25 passes into the strike plate S and the hook 55 snaps out of the longitudinal aperture 30 and behind the strike plate S to secure or latch the sliding door closed.

Further aiding in the hooking and latching movement of the pivoting lever 40 is a guide means comprising a guide aperture 95 formed in and usually, but necessarily, through the lever 40 and a guide pin 100 that extends through a guide pin receiving aperture 105 in the deadbolt 25 and into and usually, but not necessarily, through the guide aperture 95. The guide pin 100 may merely fit within a guide aperture 95 that partially penetrates the lever 40. Specifically, as seen in FIG. 4, the guide aperture is located within the lever 40 and extends from proximate the first or head end of the lever 40 and proximate or partially beside the channel 60. The interaction between the guide pin 100 and the internal shape of the guide aperture 95 dictates the limits of the path available to the lever 40 during the pivoting motion for latching and unlatching with the strike plate S. Although the preferred shape of the guide aperture 95 is generally triangular, other shapes for the guide aperture 95 are considered acceptable if the selected shape of the guide aperture 95 is such that when the deadbolt 25 is extended the lever 40 is directed out of the channel 30 and when the deadbolt 25 is retracted, the shape of the guide aperture 95 aids in the directed movement of the lever 40 into the channel 30. The guide aperture 95 is no restricted to a tightly confined pathway for the guide pin 100, but is fairly spacious. The guide aperture 40 has sufficient space for variability in the exact pivotal position of the lever 40, thus permitting an assisting or aiding action in the pivoting and not a strictly forced directional path. By placing limits of the pivoting motion of the lever 40, the guide means helps to establish a reliable latching motion for the lever 40.

Deadbolt extension means are provided to actuate the sliding of the deadbolt assembly between a nonengaging position and an engaging position for latching the hook 55 with the strike plate S. Preferably, although not exclusively, the extension means comprises a cam-lever 70 that fits within the deadbolt notch 35. The cam-lever 70 is pivoted within the housing to slide the deadbolt 25 in and out by rotating with suitable means such as a standard handle attached to the coupling region 75. As seen in FIGS. 4 and 5, the cam-lever 70 is configured to fit within the deadbolt notch 35 and upon appropriate rotation the cam-lever 70 forces the deadbolt 25 out of and into the housing. In FIGS. 1–3 the top of the cam-lever 70 is seen in three positions partially extending above the deadbolt notch 35. To provide suitable resistance for the deadbolt 25 out and in sliding movement, resilient means, usually a spring 80, is supplied.

Typically, a user employs the subject device by mounting in a suitable sliding door D. The user does not need to be worried about whether or not the deadbolt 25 is extended when the door D is closed onto the strike plate S. In any withdrawn (FIG. 2), partially extended (FIG. 3), or totally extended (FIG. 1) position the deadbolt 25 will pass into the receiving strike plate S opening. The lever 40 and associated hook 55 deflect into the deadbolt longitudinal aperture 30 via the variable pivot point within the lever channel 60, as aided by the limits set by guide means. When the deadbolt 25 is withdrawn from the strike plate S and back into the housing the lever 40 cooperates with the housing structure, also aided by the guide means, to pivot the lever 40 back into the longitudinal aperture to release the strike plate S. Usually, a nub 85 on the lever 40 catches within a slot 90 in the housing and initiates pivoting of the lever 40 and associated hook 55 into the longitudinal aperture 30.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A self-latching deadbolt assembly for mounting in a sliding door and engaging with a strike plate means, comprising:

a sliding deadbolt member having first and second ends;

a lever having first and second ends;

hooking means associated with said lever first end for engaging the strike plate means, wherein said hooking means comprises a hook formed in said lever proximate said lever first end;

a channel formed within said lever extending from proximate said lever second end towards said lever first end;

pivoting means for connecting said lever by said channel to said deadbolt member;

biasing means for providing a variable point of pivoting within said channel whereby said pivoting varies from proximate said lever second end toward said lever first end and wherein said biasing means comprises a spring fitted within said channel that cooperates with said pivoting means; and guide means for aiding in directing a motion of said lever, wherein said guide means comprises a guide aperture formed in said lever.

2. A self-latching deadbolt assembly according to claim 1, wherein said guide means further comprises:

a guide pin that fits within said guide aperture;

a guide pin receiving aperture formed in said deadbolt member which secures said guide pin within said guide aperture.

3. A self-latching deadbolt assembly according to claim 1, wherein said guide means further comprises:

said guide aperture is triangular in shape;

a guide pin that fits within said guide aperture;

a guide pin receiving aperture formed in said deadbolt member which secures said guide pin within said guide aperture.

4. A latch assembly for mounting to a sliding door and engaging with a strike plate means, comprising:

a) a housing for fitting within the sliding door;

b) self-latching deadbolt means associated with said housing for engaging with the strike plate means comprising a deadbolt assembly comprising:

a sliding deadbolt member having first and second ends;

a lever having first and second ends;

hooking means associated with said lever first end for engaging the strike plate;

a channel formed within said lever extending from proximate said lever second end towards said lever first end;

pivoting means for connecting said lever by said channel to said deadbolt member;

biasing means for providing a variable point of pivoting within said channel whereby said pivoting varies from proximate said lever second end toward said lever first end; and guide means for aiding in directing a motion of said lever; wherein said guide means comprises a guide aperture formed in said lever; and c) deadbolt extension means associated with said housing for sliding said self-latching deadbolt means between a nonengaging position and an engaging position with the strike plate means.

5. A latch assembly according to claim 4, wherein said guide means further comprises:

a) a guide pin that fits within said guide aperture;

b) a guide pin receiving aperture formed in said deadbolt member which secures said guide pin within said guide aperture.

6. A latch assembly for mounting to a sliding door and engaging with a strike plate means, comprising:

a) a housing for fitting within the sliding door;

b) self-latching deadbolt means associated with said housing for engaging with the strike plate means comprising a deadbolt assembly comprising:

a sliding deadbolt member having first and second ends;

a lever having first and second ends;

hooking means associated with said lever first end for engaging the strike plate, wherein said hooking means comprises a hook formed in said lever proximate said lever first end;

a channel formed within said lever extending from proximate said lever second end towards said lever first end;

pivoting means for connecting said lever by said channel to said deadbolt member;

biasing means for providing a variable point of pivoting within said channel whereby said pivoting varies from proximate said lever second end toward said lever first end and wherein said biasing means comprises a spring fitted within said channel that cooperates with said pivoting means; and guide means for aiding in directing a motion of said lever, wherein said guide means comprises:

a guide aperture formed in said lever;

a guide pin that fits within said guide aperture;

a guide pin receiving aperture formed in said deadbolt member which secures said guide pin within said guide aperture; and c) deadbolt extension means associated with said housing for sliding said self-latching deadbolt means between a nonengaging position and an engaging position with the strike plate means.

7. A latch assembly according to claim 6, wherein said guide aperture is triangular in shape and extends through said lever.

* * * * *